US009180725B2

(12) United States Patent
Lin

(10) Patent No.: US 9,180,725 B2
(45) Date of Patent: Nov. 10, 2015

(54) TRIANGLE RULER CAPABLE OF MEASURING ANGLES

(71) Applicant: Kun-Meng Lin, Changhua County (TW)

(72) Inventor: Kun-Meng Lin, Changhua County (TW)

( * ) Notice: Subject to any disclaimer, the term of this patent is extended or adjusted under 35 U.S.C. 154(b) by 169 days.

(21) Appl. No.: 13/958,638

(22) Filed: Aug. 5, 2013

(65) Prior Publication Data

US 2015/0033568 A1 Feb. 5, 2015

(51) Int. Cl.
*B43L 7/033* (2006.01)

(52) U.S. Cl.
CPC ..... *B43L 7/033* (2013.01)

(58) Field of Classification Search
USPC ..... 33/340, 424, 429, 451, 481, 482
See application file for complete search history.

(56) References Cited

U.S. PATENT DOCUMENTS

| | | | | | |
|---|---|---|---|---|---|
| 567,832 | A * | 9/1896 | Johns | 33/340 |
| 1,395,510 | A * | 11/1921 | Minion | 33/41.2 |
| 1,972,122 | A * | 9/1934 | Woodyard | 33/424 |
| 4,404,753 | A * | 9/1983 | Klok | 33/451 |
| 4,974,329 | A * | 12/1990 | Willa | 33/391 |
| 4,995,169 | A * | 2/1991 | Lunden | 33/534 |
| 2006/0124390 | A1 * | 6/2006 | Rivers et al. | 182/18 |
| 2013/0227846 | A1 * | 9/2013 | Buzzell | 33/32.2 |

* cited by examiner

*Primary Examiner* — Sarah B McPartlin

(57) ABSTRACT

A triangle ruler includes a triangle ruler body defining three corners, three sides, opposing first surface and second surface surrounded by the three sides and three corners and a recessed annular scale located at the center thereof, and a direction indicator including a pendulum and a pointer and pivoting about the center of the recessed annular scale in such a manner that the pivot axis of the direction indicator extends perpendicular to the first and second surfaces of the triangle ruler body, and the effects of the weight of the direction indicator keeps one end of the pointer to constantly indicate a predetermined direction. Thus, the invention combines the functions of a conventional protractor and a conventional triangle ruler to facilitate drawing a variety of different angles of lines.

14 Claims, 6 Drawing Sheets

TRIANGLE RULER CAPABLE OF MEASURING ANGLES

BACKGROUND OF THE INVENTION

1. Field of the Invention

The present invention relates to rulers, and more particularly to a triangle ruler that can be used to draw a variety of different angles of lines.

2. Description of the Related Art

People may need to draw a variety of lines by hand to meet different drawing needs. When drawing a variety of different angles of lines, mapping tools such as ruler, triangle ruler and protractor may be used.

Linear mapping tools include a ruler marked with a linear scale and a carbon pencil. Subject to the guide of the ruler, the carbon pencil is driven to draw a line segment subject to a predetermined length and then to extend a known line segment.

However, the known technique is to draw a line segment of a predetermined length subject to the assistance of one straight edge of the ruler and the linear scale at the ruler. During mapping, one may need to draw vertical lines of predetermined lengths, parallel lines subject to predetermined pitches, and lines that define with the respective vertical lines and respective contained angle. Using one single ruler cannot draw the aforesaid different angles of lines. At this time, a triangle ruler, protractor or other mapping tools shall be needed. However, it is inconvenient to carry a large number of mapping tools and to use different mapping tools during drawing. Therefore, there is room for improvement on conventional mapping tools.

SUMMARY OF THE INVENTION

The present invention has been accomplished under the circumstances in view. It is the main object of the present invention to provide a triangle ruler, which utilizes the effects of gravity to keep a pointer in a constant indication direction so that the triangle ruler combines the functions of a conventional protractor and a conventional triangle ruler for drawing a variety of different angles of lines.

To achieve this and other objects of the present invention, a triangle ruler comprises a triangle ruler body and a direction indicator. The triangle ruler body defines three corners, three sides, opposing first surface and second surface surrounded by the three sides and three corners and a recessed annular scale located at the center thereof. The direction indicator comprises a pendulum and a pointer, and is pivotally disposed in the center of the recessed annular scale in such a manner that the pivot axis of the direction indicator extends perpendicular to the first and second surfaces of the triangle ruler body, and the effects of the weight of the direction indicator keeps one end of the pointer to constantly indicate a predetermined direction.

Thus, the triangle ruler enables the pointer to constantly indicate a predetermined direction subject to the effects of weight, facilitating measuring angles upon rotation of the triangle ruler body.

Further, subject to change of the pivot position between the pendulum and the pointer, the indicating direction of the pointer is relatively changed to fit different users or different application requirements.

Further, by means of mounting a see-through protective covers in the two opposite sides of the recessed annular scale, the user can see the triangle ruler from either side during application.

DETAILED DESCRIPTION OF THE INVENTION

Other and further advantages and features of the present invention will be understood by reference to the description of the invention in conjunction with the accompanying drawings where the components are illustrated based on a proportion for explanation but not subject to the actual component proportion.

Figure 1:
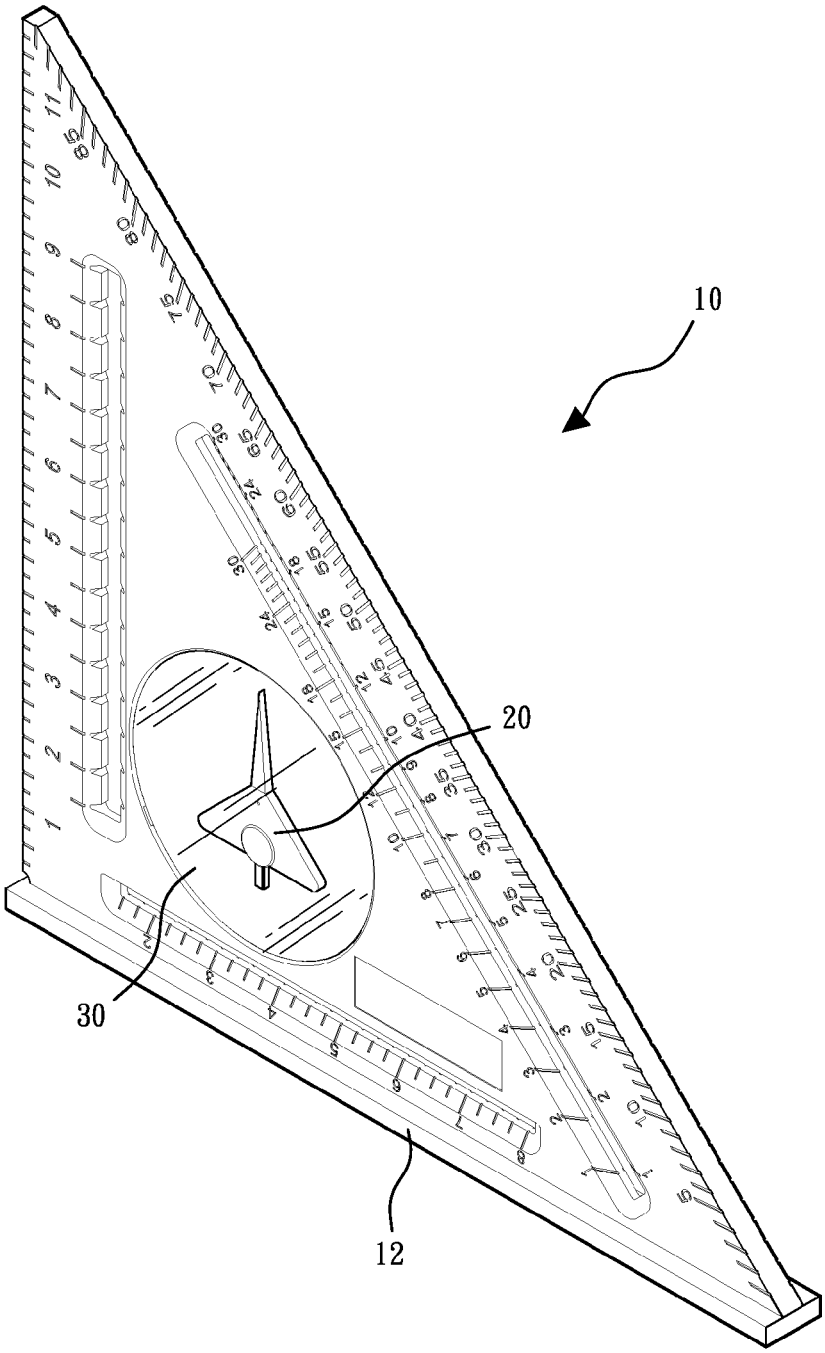
FIG. 1 is a perspective view of a triangle ruler in accordance with the present invention.
Figure 2:
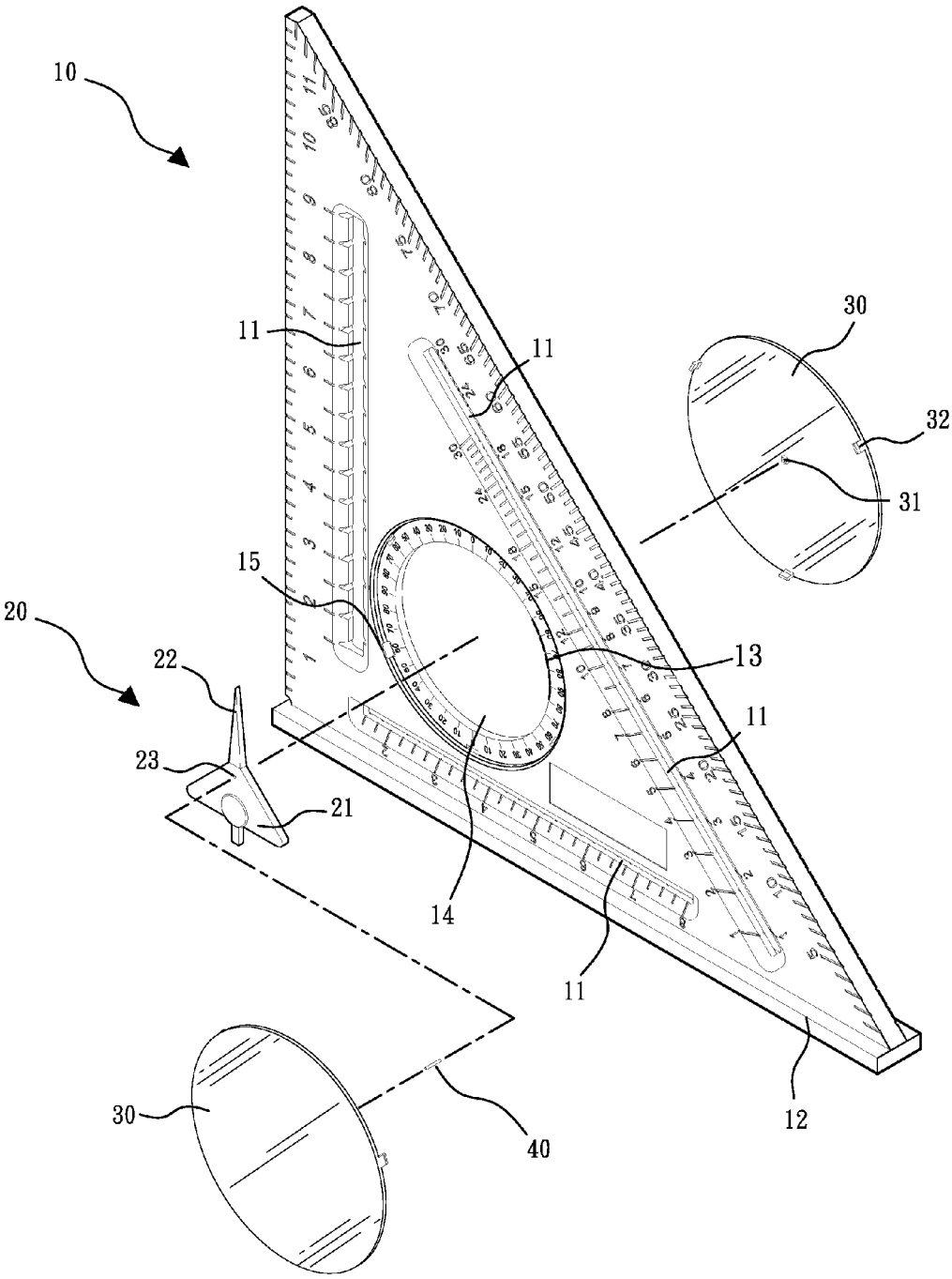
FIG. 2 is an exploded view of the triangle ruler in accordance with the present invention.
Figure 3:
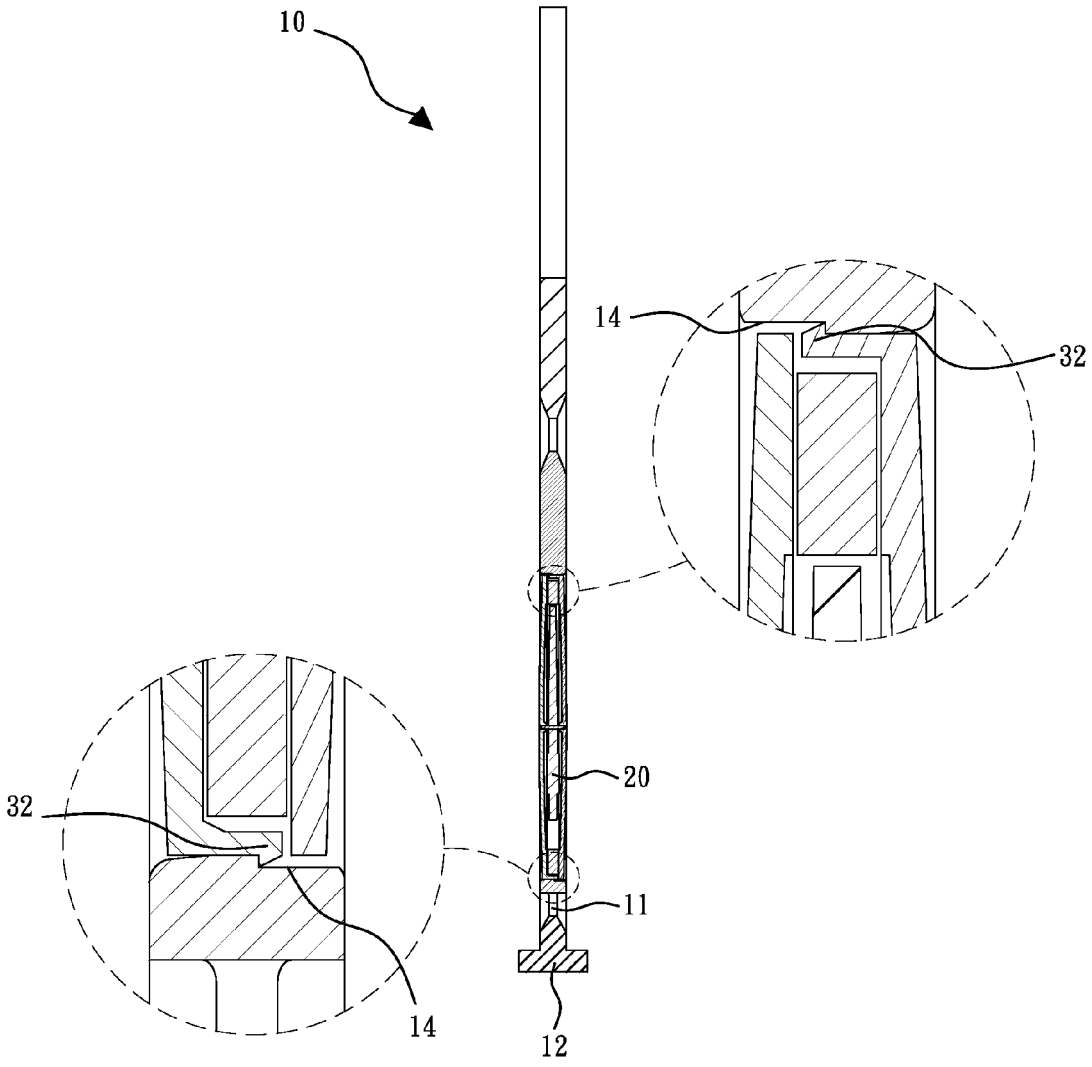
FIG. 3 is a schematic sectional view of the triangle ruler in accordance with the present invention.

Referring to FIGS. 1-3, a perspective view, an exploded view and a schematic sectional view of a triangle ruler in accordance with the present invention is shown. As illustrated, the triangle ruler comprises a triangle ruler body 10, a direction indicator 20, two protective covers 30, and a pivot 40.

The triangle ruler body 10 is a polygon with three corners and three sides, defining opposing first surface and second surface. In this embodiment, the triangle ruler body 10 comprises three linear slots 11 cut through the opposing first surface and second surface and respectively disposed in parallel to the three sides, a flat rail 12 located at and extending along one of the three sides, a variety of linear scales of different systems (such as metric system, English system, etc.) printed on the first surface and/or second surface of the triangle ruler body 10 adjacent to the three sides and the three linear slots 11, a recessed annular scale 13 located at the center of the triangle ruler body 10, a circular center opening 14 cut through the opposing first surface and second surface and surrounded by the recessed annular scale 13, and a plurality of retaining lugs 15 that are stepped lugs respectively extended from the opposing first surface and second surface and equiangularly spaced around the recessed annular scale 13. Further, the flat rail 12 is disposed in a perpendicular manner relative to the opposing first surface and second surface of the triangle ruler body 10 for supporting the triangle ruler body 10 on a planar surface 50 of an external object in an upright position.

The direction indicator 20 comprises a pendulum 21 and a pointer 22. The direction indicator 20 is pivotally disposed in the center of the recessed annular scale 13 in such a manner that the pivot axis of the direction indicator 20 extends perpendicular to the first surface and the second surface and, the weight of the direction indicator 20 keeps one end of the pointer 22 to constantly indicate a predetermined direction. Further, one end of the pendulum 21 that is connected to the pointer 22 is relatively narrower. The other end of the pendulum 21 is relatively broader. Further, the weight of the pendulum 21 is heavier than the weight of the pointer 22 so that the pendulum 21 can swing freely relative to the triangle ruler body 10. In this embodiment, the pendulum 21 is shaped like a triangle, having a pivot hole 23.

The two protective covers 30 are transparent circular plate members symmetrically attached to two opposite sides of the the recessed annular scale 13 and kept in flush with the opposing first surface and second surface of the triangle ruler body 10 so that the user can see through the circular opening 14 from each of two opposite sides. Further, each protective cover 30 comprises a center groove 31 at the center of an inner side thereof, and a plurality of engagement members, for example, hooks 32 equiangularly spaced around the periphery corresponding to the retaining lugs 15. The center grooves 31 of the two protective covers 30 work as axle bearing means. The hooks 32 of the two protective covers 30 are adapted to hook up with the retaining lugs 15 of the triangle ruler body 10.

The pivot 40 is a needle member mounted in the pendulum 21 and supported in the center grooves 31 of the protective covers 30 to suspend the pendulum 21 from the center of the recessed annular scale 13. In this embodiment, the flat rail 12 works as a reference side for the triangle ruler body 10. When the reference side, i.e., the flat rail 12 of the triangle ruler body 10 is supported on the planar surface 50, one end of the pointer 22 indicates the other direction opposite to the reference side.

After understanding of the structural features and shapes of the component parts of the triangle ruler, the functioning and effects of the present invention are outlined hereinafter.

Figure 4A:
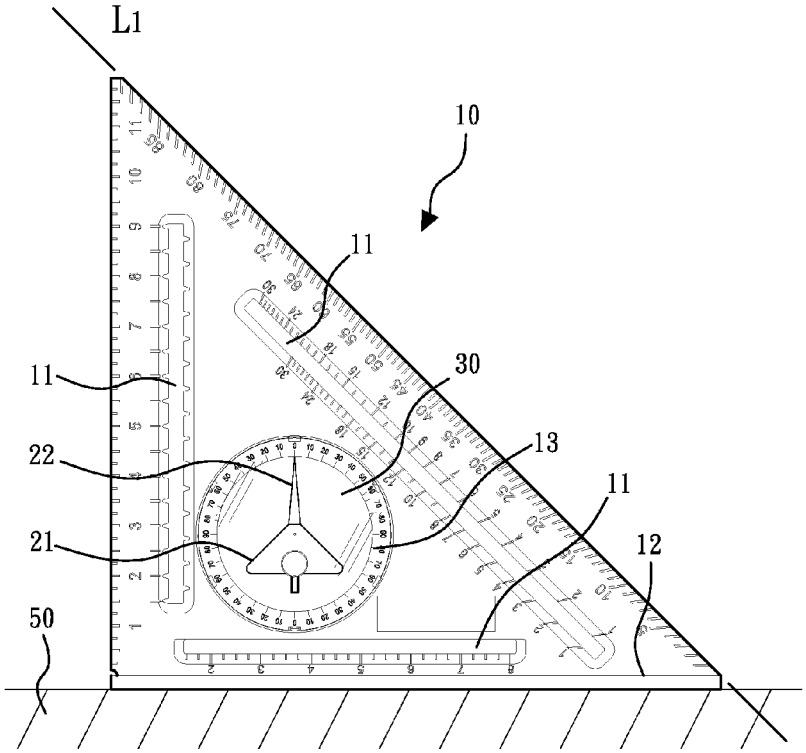
FIG. 4A is a schematic drawing illustrating an application example of the triangle ruler in accordance with the present invention (I).
Figure 4B:
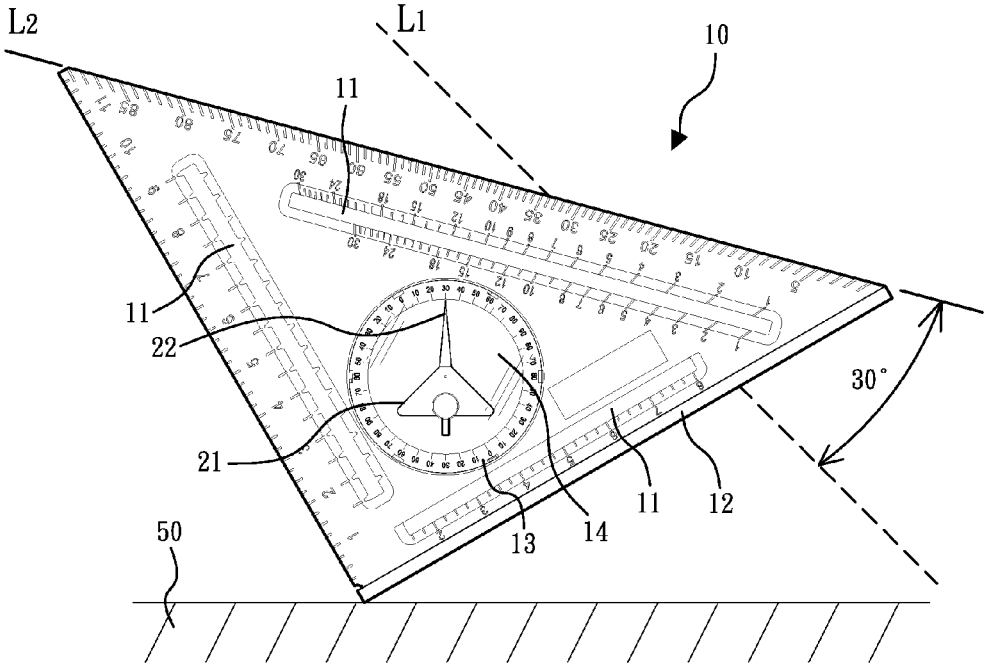
FIG. 4B is a schematic drawing illustrating an application example of the triangle ruler in accordance with the present invention (II).

Referring to FIGS. 4A and 4B, during application of the triangle ruler, the reference side, i.e., the flat rail 12 of the triangle ruler body 10 is supported on the planar surface 50. At this time, the pendulum 21 is kept in the resting equilibrium position subject to the effects of gravity, causing the pointer 22 to indicate with its one end in the direction reversed to the reference side, the upward direction relative to the planar surface 50. At this time, the pointer 22 points out a specific value at the recessed annular scale 13, and the user can then draw a reference line L1 along one side of the triangle ruler body 10 opposite to the flat rail 12, and then bias the triangle ruler body 10 clockwise or counter-clockwise relative to the planar surface 50 to move the recessed annular scale 13 through a predetermined angle subject to the indication of the pointer 22 at the recessed annular scale 13, and then draw a destination line L2 that intersects with the reference line L1 at a predetermined angle. Thus, the user can draw a variety of different angles of lines. In this application example, the angle of the reference line L1 is 0°; and the angle of the destination line L2 is 30°; the angle of rotation of the triangle ruler body 10 relative to the planar surface 50 is 30°; the contained angle defined between the reference line L1 and the destination line L2 is 30°. Further, the invention has a variety of linear scales of different systems printed on the first surface and/or second surface of the triangle ruler body 10 adjacent to the three sides and the three linear slots 11 for measurement, facilitating drawing a variety of different angles of lines.

Figure 5:
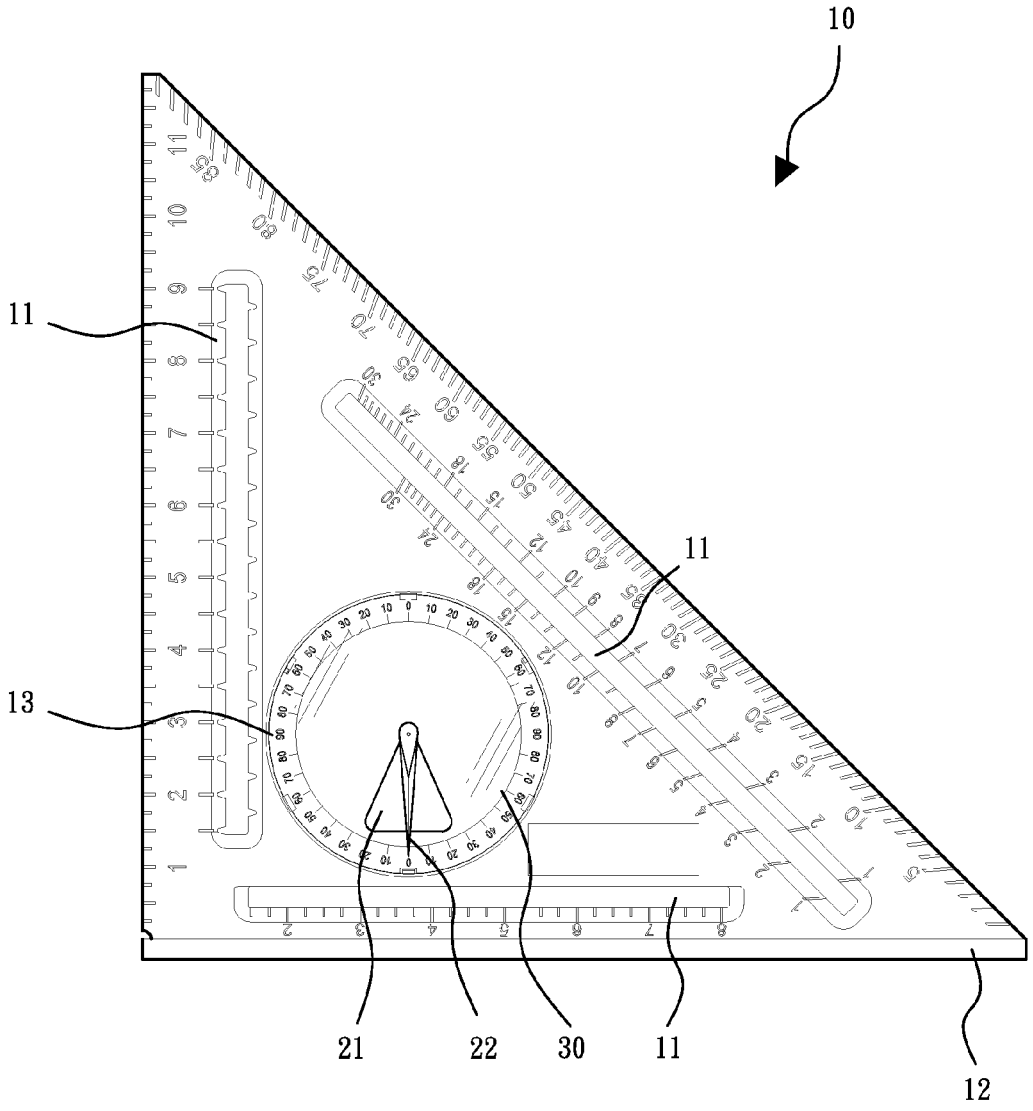
FIG. 5 is an exploded view of an alternate form of the triangle ruler in accordance with the present invention.
Figure 6:
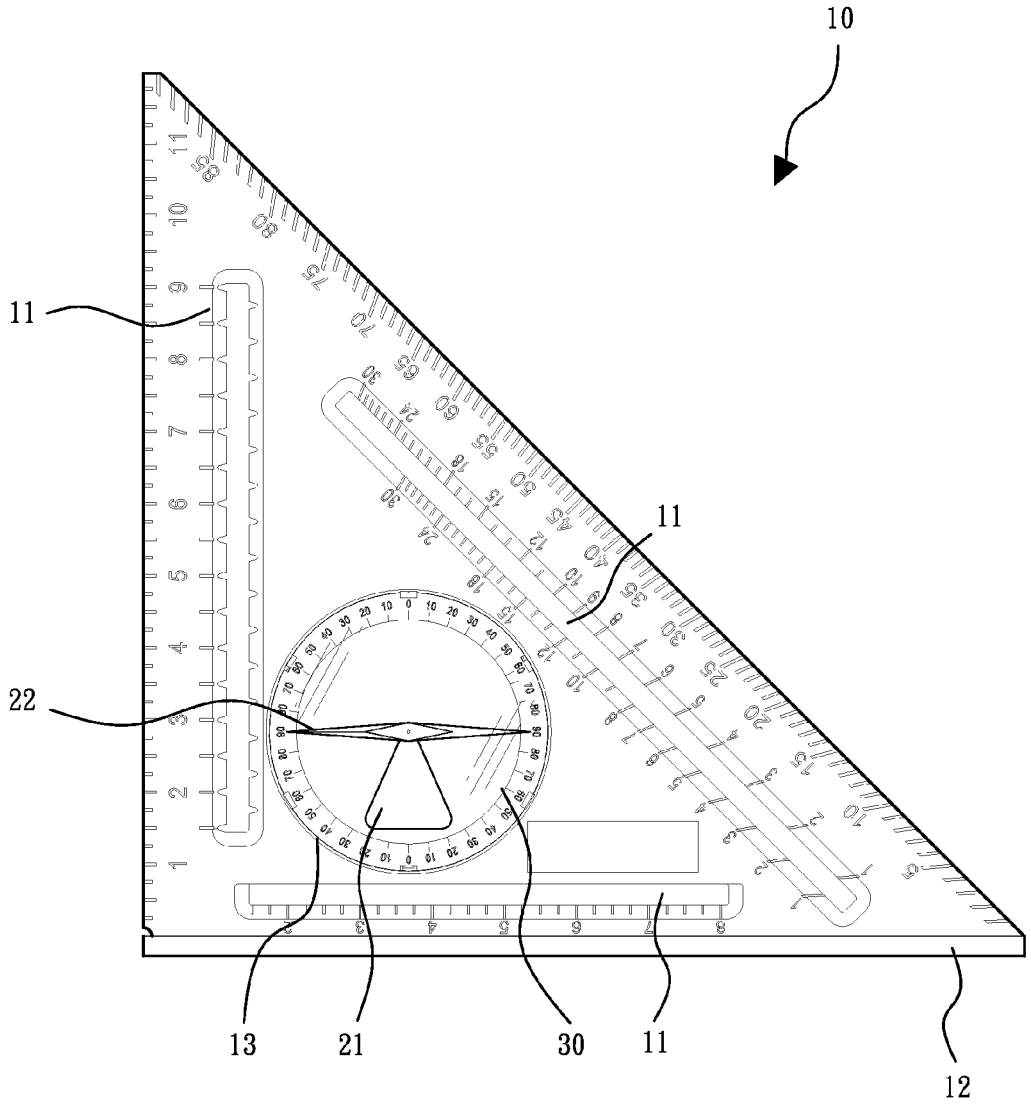
FIG. 6 is an exploded view of another alternate form of the triangle ruler in accordance with the present invention.

FIG. 5 illustrates an alternate form of the triangle ruler in accordance with the present invention. According to this alternate form, the pointer 22 has one end thereof pivotally disposed in the center of the recessed annular scale 13 of the triangle ruler body 10, and the pendulum 21 is disposed between the two opposite ends of the pointer 22. This design enables the gravity center of the pendulum 21 to be maintained close to the other end of the pointer 22. Thus, when the reference side, i.e., the flat rail 12 of the triangle ruler body 10 is positioned on a planar surface 50 and then the triangle ruler body 10 is turned relative to the planar surface 50, the other end of the pointer 22 constantly indicates the reference side, i.e., the bottom side of the planar surface 50, facilitating angle measurement FIG. 6 illustrates another alternate form of the triangle ruler in accordance with the present invention. According to this alternate form, the pendulum 21 is pivotally disposed in the center of the recessed annular scale 13 of the triangle ruler body 10, and the pointer 22 extends from one end of the pendulum 21 in reversed directions. Thus, the pendulum 21 and the pointer 22 form a configuration like a balance scale. When the reference side, i.e., the flat rail 12 of the triangle ruler body 10 is positioned on a planar surface 50 and then the triangle ruler body 10 is turned relative to the planar surface 50, the pointer 22 is kept in parallel to the reference side, working like a level, facilitating angle measurement.

In conclusion, the triangle ruler enables the pointer 22 to constantly indicate a predetermined direction subject to the effects of weight, facilitating measuring angles upon rotation of the triangle ruler body 10. Further, subject to change of the pivot position between the pendulum 21 and the pointer 22, the indicating direction of the pointer 22 is relatively changed to fit different users or different application requirements. Further, by means of mounting the see-through protective covers 30 in the two opposite sides of the recessed annular scale 13, the user can see the triangle ruler from either side during application.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A triangle ruler, comprising:

a triangle ruler body being a polygon with three corners and three sides, said triangle ruler body comprising opposing first surface and second surface, a recessed annular scale at the center thereof, and a circular opening surrounded by said recessed annular scale;

at least one transparent protective cover mounted in said circular opening at one side, said protective cover comprising a plurality of engagement members, wherein said triangle ruler body further comprises a plurality of retaining lugs equiangularly spaced around said recessed annular scale and respectively hooked up with said engagement members of said protective cover; and a direction indicator comprising a pendulum and a pointer, said direction indicator being pivotally disposed in the circular opening, so as to pivot with respect to said recessed annular scale in such a manner that the pivot axis of said direction indicator extends perpendicular to said first surface and said second surface of said triangle ruler body, and the effects of a weight of said direction indicator keeps one end of said pointer to constantly indicate a predetermined direction.

2. The triangle ruler as claimed in claim 1, wherein one of the three sides of said triangle ruler body is defined as a reference side, and said pendulum is pivotally disposed in the center of said recessed annular scale, such that when said reference side is positioned on a planar surface, one end of said pointer constantly indicates a direction opposite to said reference side.

3. The triangle ruler as claimed in claim 1, wherein one of the three sides of said triangle ruler body is defined as a reference side, and said pointer has one end thereof pivotally disposed in the center of said recessed annular scale, and said pendulum is disposed between two opposite ends of said pointer such that when said reference side is positioned on a planar surface, the other end of said pointer constantly points out said reference side.

4. The triangle ruler as claimed in claim 1, wherein one of the three sides of said triangle ruler body is defined as a reference side, and said pendulum is pivotally disposed in the center of said recessed annular scale, such that when said reference side is positioned on a planar surface, said pointer is kept in parallel to said reference side.

5. The triangle ruler as claimed in claim 1, wherein said pendulum is heavier than said pointer.

6. The triangle ruler as claimed in claim 1, wherein said triangle ruler comprises a total of two said transparent protective covers mounted in said circular opening at two opposite sides.

7. The triangle ruler as claimed in claim 1, wherein said engagement members are hooks; said retaining lugs are stepped members respectively hooked with said hooks.

8. The triangle ruler as claimed in claim 1, wherein each said protective cover comprises a center groove located at an inner side thereof; said direction indicator has a pivot mounted therein and pivotally coupled to said center grooves of said protective covers.

9. The triangle ruler as claimed in claim 1, wherein said triangle ruler body further comprises a plurality of linear slots cut through said first surface and second surface and respectively kept in parallel to the three sides of said triangular ruler body.

10. The triangle ruler as claimed in claim 9, wherein said triangle ruler body further comprises a linear scale respectively disposed adjacent to each said linear slot.

11. The triangle ruler as claimed in claim 1, wherein said triangle ruler body further comprises a flat rail mounted at one of the three sides thereof.

12. The triangle ruler as claimed in claim 11, wherein said flat rail extends perpendicular to said first surface and said second surface.

13. The triangle ruler as claimed in claim 1, wherein said pendulum has a relatively narrower first end connected to said pointer and relatively wider second end opposite to said first end.

14. The triangle ruler as claimed in claim 1, wherein said pendulum is shaped like a triangle.

* * * * *